US007044758B2

(12) United States Patent
Deno et al.

(10) Patent No.: US 7,044,758 B2
(45) Date of Patent: May 16, 2006

(54) LEVER FITTING-TYPE CONNECTOR

(75) Inventors: Masahiro Deno, Haibara-gun (JP); Teruhiko Ohike, Haibara-gun (JP); Akira Ozawa, Wako (JP); Kouichi Hasegawa, Wako (JP); Nobuchika Ukai, Wako (JP); Takefumi Ikegami, Wako (JP)

(73) Assignees: Yazaki Corporation, Tokyo (JP); Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/094,192

(22) Filed: Mar. 31, 2005

(65) Prior Publication Data

US 2005/0221648 A1 Oct. 6, 2005

(30) Foreign Application Priority Data

Mar. 31, 2004 (JP) ..... P2004-107358

(51) Int. Cl.
*H01R 13/62* (2006.01)

(52) U.S. Cl. ..... 439/157

(58) Field of Classification Search ..... 439/157, 439/372, 489, 371
See application file for complete search history.

(56) References Cited

U.S. PATENT DOCUMENTS 5,435,738 A * 7/1995 Isohata ..... 439/157
5,575,676 A * 11/1996 Tsukakoshi et al. ..... 439/347
6,328,582 B1 * 12/2001 Fukamachi ..... 439/157
6,679,711 B1 * 1/2004 Takahashi ..... 439/157

FOREIGN PATENT DOCUMENTS

JP 8-241759 A 9/1996

* cited by examiner

*Primary Examiner*—Phuong Dinh
(74) *Attorney, Agent, or Firm*—Sughrue Mion, PLLC

(57) ABSTRACT

A lever fitting-type connector includes a first connector on which a fitting detection member is slidably mounted a second connector, which is adapted to be fitted into the first connector, and a connecting lever which is provided on either one of the first and second connectors for operating the first and second connectors from a provisionally fitted condition to a completely fitted condition to each other. The fitting detection member slides to a lock position so that the fitting detection member is engaged with a first engagement hole of the connecting lever to lock the connecting lever in the completely fitted condition. When the fitting detection member is positioned at the lock position, a lock confirmation portion of the fitting detection member is projected from both of the first engagement hole and a distal end face of the connecting lever.

9 Claims, 8 Drawing Sheets

LEVER FITTING-TYPE CONNECTOR

BACKGROUND OF THE INVENTION

This invention relates to a lever fitting-type connector used, for example, for electrically connecting a motor of an automobile to an inverter.

There have been extensively used lever fitting-type connectors of the type, in which female and male connectors are provisionally fitted together, and then a connecting lever is pivotally moved to completely fit the two connectors together, and in this condition this connecting lever is locked by a fitting detection member so as to hold the two connectors in the completely-fitted condition.

In this lever fitting-type connector, the fitting detection member, having a slider portion and a lock portion, is slidably mounted on the male connector. As a method of confirming whether or not the fitting detection member is located in a proper lock position, there has been proposed a method in which the operator confirms with the eyes whether or not the fitting detection member is disposed flush with the connecting lever (see, for example, JP-A-8-241759 (Paragraph [0034], FIG. 6(*c*)).

However, this method has the following disadvantages.

Firstly, whether or not the fitting detection member is disposed flush with the connecting lever is merely judged with the eyes, and therefore there is a risk that some operators may make an error in judgment.

Secondly, particularly when the connector is used in a situation in which a space is severely limited or in an environment in which illumination facilities are inadequate, there is encountered a problem with the efficiency of the operation.

It is an object of this invention to provide a lever fitting-type connector capable of overcoming the above disadvantages.

SUMMARY OF THE INVENTION

In order to achieve the above object, according to the present invention, there is provided a lever fitting-type connector, comprising:

a first connector, on which a fitting detection member is slidably mounted;

a second connector, which is adapted to be fitted into the first connector; and a connecting lever, which is provided on either one of the first and second connectors for operating the first and second connectors from a provisionally fitted condition to a completely fitted condition to each other, wherein the fitting detection member slides to a lock position so that the fitting detection member is engaged with a first engagement hole of the connecting lever to lock the connecting lever in the completely fitted condition; and wherein when the fitting detection member is positioned at the lock position, a lock confirmation portion of the fitting detection member is projected from both of the first engagement hole and a distal end face of the connecting lever.

Preferably, the fitting detection member includes a body portion, and an elastic arm formed on the body portion such that the elastic arm is turned back from the body portion. The elastic arm has a claw for engaging with a second engagement hole of the connecting lever to prevent a movement of the body portion. The lock confirmation portion is formed at a turned back portion of the elastic arm.

Preferably, The lock confirmation portion is different in color from the connecting lever.

Preferably, a color of the lock confirmation portion and a color of the connecting lever have a relationship of complementary colors.

Preferably, The lock confirmation portion is formed at a distal end of the fitting detection member in a sliding direction of the fitting detection member toward the first engagement hole.

Preferably, The fitting detection member is locked in the provisionally fitted condition. The lock state of the fitting detection member is released by a turn operation of the connecting lever to the completely fitted condition.

In the above configuration, even an unskilled operator can correctly judge whether or not the connecting lever is locked. Further, even in the case where it is difficult to view the fitting detection member with the eyes, the correct judgment can be formed by touching the fitting detection member, and therefore there is no problem with the efficiency of the operation.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

A preferred embodiment of the present invention will now be described with reference to the drawings.

Figure 1:
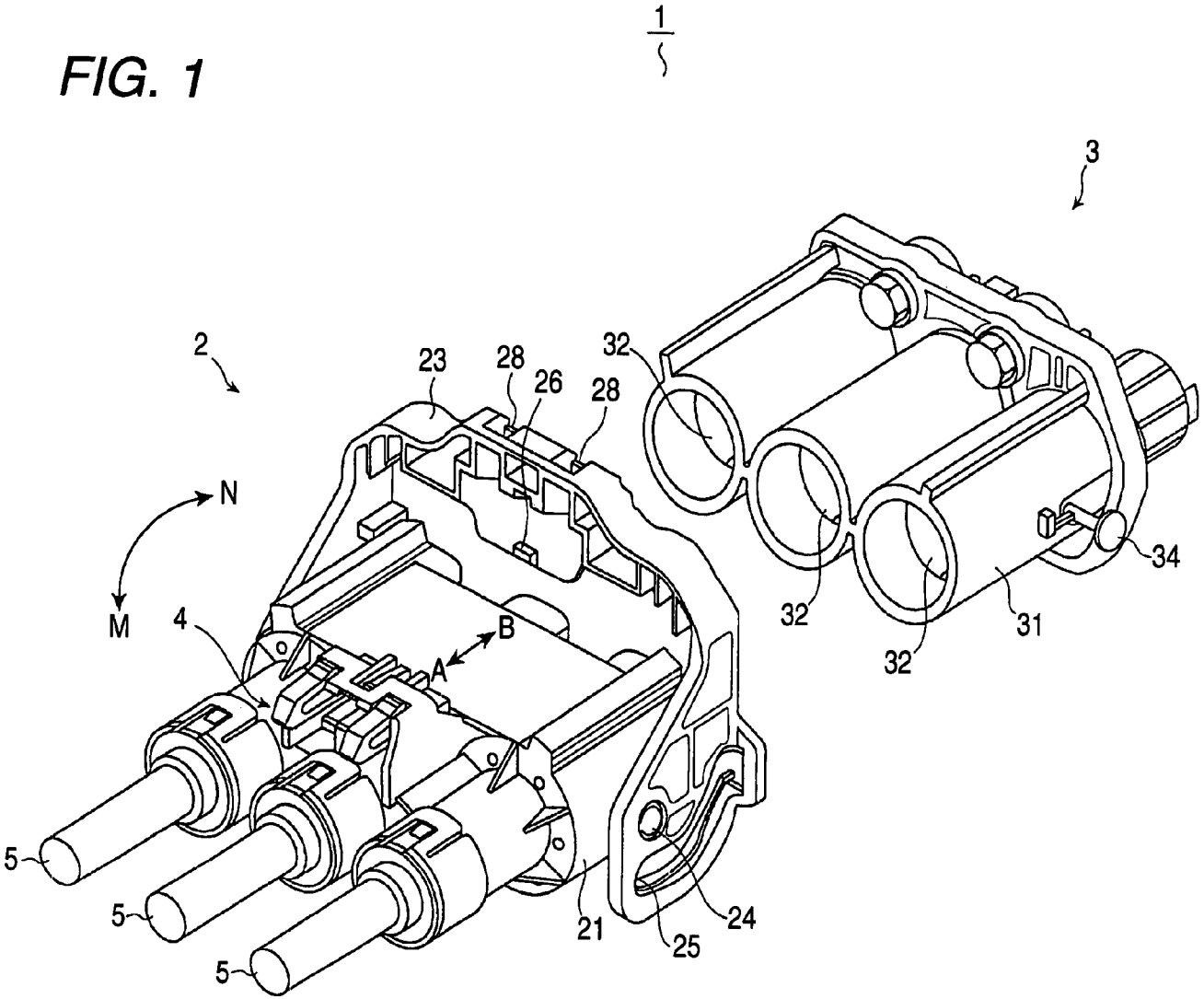
FIG. 1 a perspective view of a lever fitting-type connector in a condition right before a fitted condition is achieved according to one preferred embodiment of the present invention.

As shown in FIG. 1, a lever fitting-type connector 1 includes a male connector 2, a female connector 3, and a fitting detection member 4.

Figure 3:
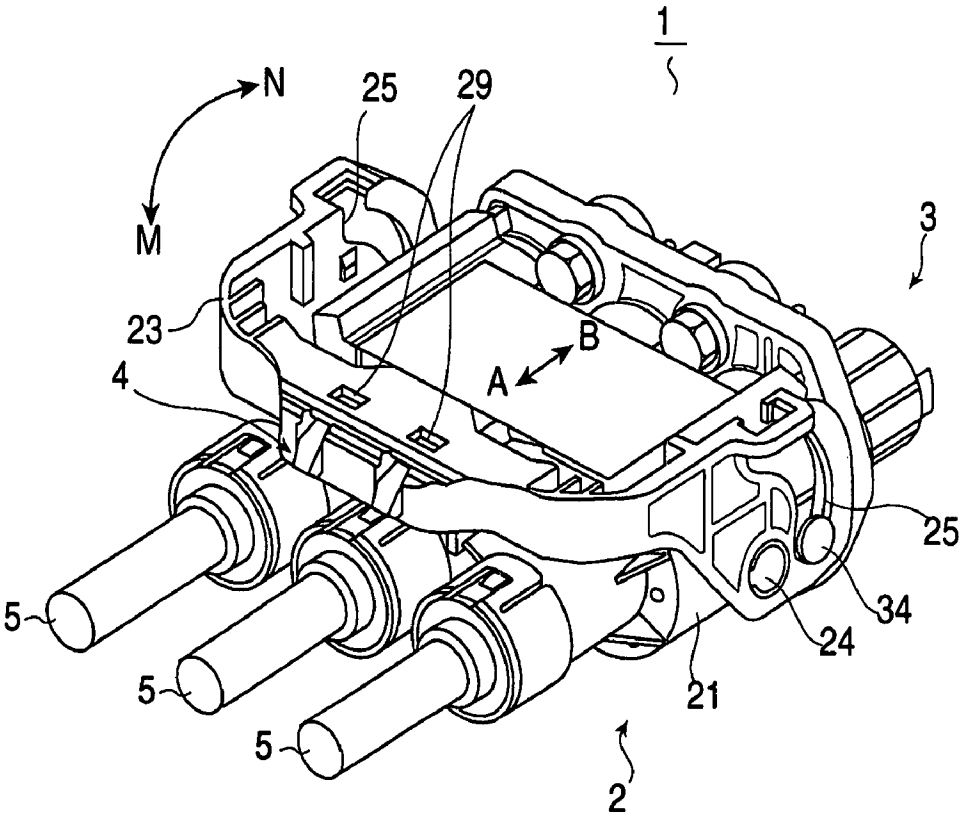
FIG. 3 is a perspective view of the lever fitting-type connector of FIG. 1 in a completely-fitted condition.
Figure 4:
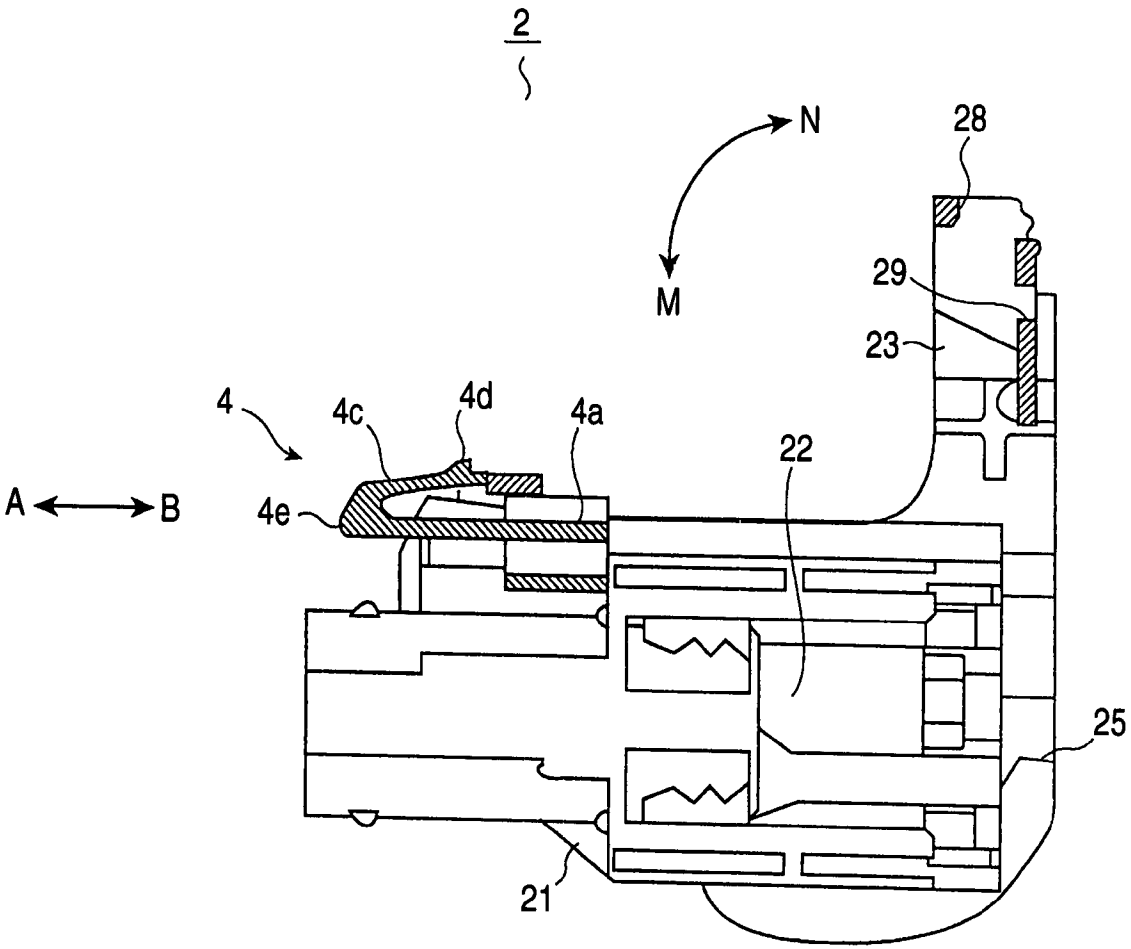
FIG. 4 is a cross-sectional view of the lever fitting-type connector of FIG. 1 in non-fitted condition.
Figure 7:
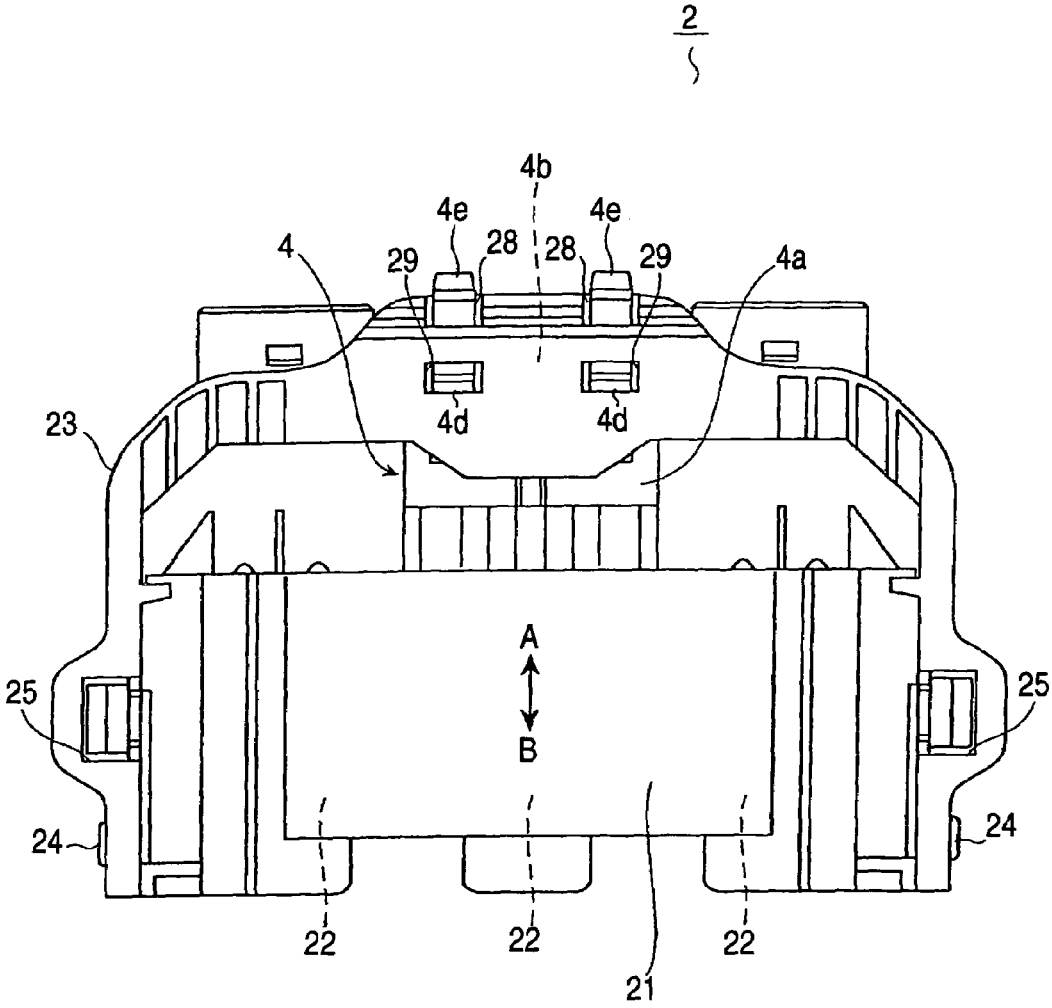
FIG. 7 is a plan view of the lever fitting-type connector of FIG. 1 in a completely-fitted (locked) condition.

The male connector includes a housing 21 of a red color made of a synthetic resin, and three male terminals 22 which are contained in the housing 21 as shown in FIGS. 1 and 7. Wires 5 are connected to the male terminals 22, respectively. A pair of pins 24 are formed on and project from opposite side surfaces of the housing 21, respectively. A U-shaped connecting lever 23 of a red color made of a synthetic resin is mounted on these pins 24 so as to be pivotally moved about these pins 24 in directions of arrows M and N. Guide grooves 25 are formed respectively in two leg portions of the connecting lever 23, and each of the guide grooves 25 is formed into an arcuate shape such that the distance between the guide groove 25 and the corresponding pin 24 is decreasing gradually from an open distal end of the guide groove 25 toward an inner end thereof. As shown in FIGS. 1 and 3, a provisionally-retaining lock cancellation projection 26, a pair of fitting detection member engagement holes 28 and a pair of completely-retaining lock engagement holes 29 are provided at a grip portion of the connecting lever 23.

Figure 8:
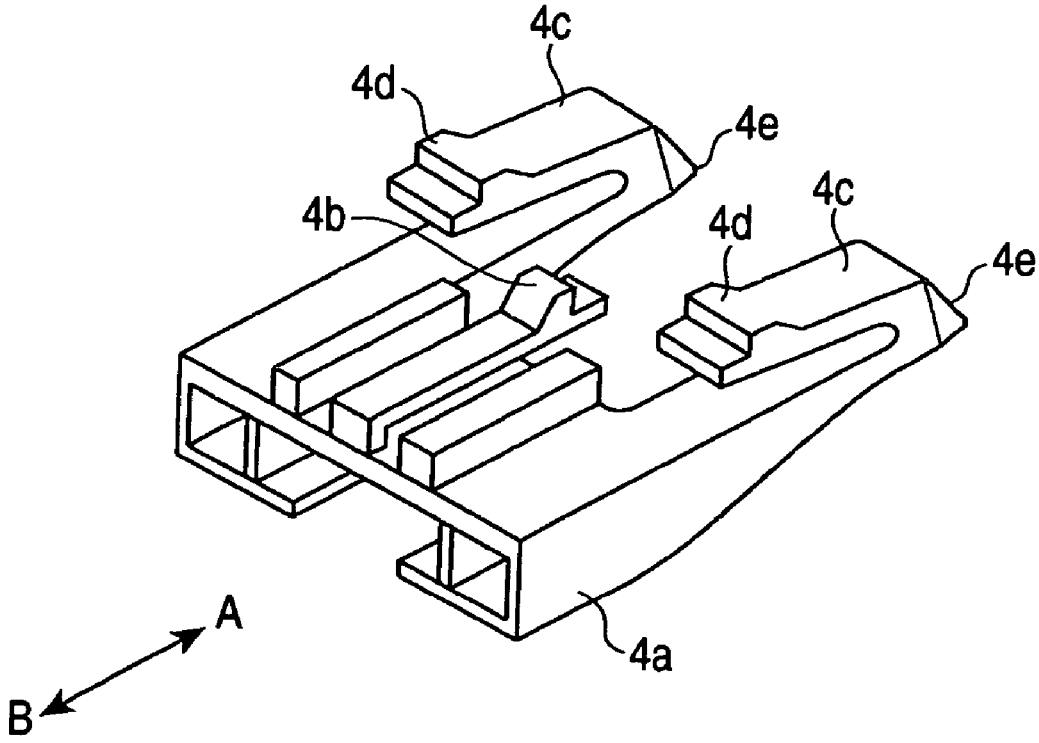
FIG. 8 is a perspective view of a fitting detection member of the lever fitting-type connector of FIG. 1.

The fitting detection member 4 has a blue-green color, and is made of a synthetic resin, and the fitting detection member 4 is mounted on the housing 21 of the male connector so as to move forward and backward in directions of arrows A and B as shown in FIG. 1. As shown in FIG. 8, the fitting detection member 4 includes a body portion 4*a*, and a provisionally-retaining portion 4*b* is formed on the body portion 4*a* in a cantilever manner so as to be elastically move upward and downward. A pair of U-shaped elastic arms 4*c* are formed or molded integrally on the body portion 4*a* such that each elastic arm 4*c* first extends in the direction of arrow A, and then is turned back to extend in the direction of arrow B. A return prevention claw 4*d* is integrally formed at a distal end portion of each elastic arm 4*c*. A lock confirmation portion 4*e* is formed integrally on and projects from that portion of the elastic arm 4*c* at which the elastic arm 4*c* is turned back from the body portion 4*a*. Usually, the provisionally-retaining portion 4*b* of the fitting detection member 4 is retainingly engaged with the housing 21 of the male connector 2, so that the fitting detection member 4 is prevented from forward movement in the direction of arrow A.

On the other hand, the female connector 3 includes a housing 31 of a red color made of a synthetic resin, and three female terminals 32 are contained in the housing 31. A pair of pins 34 are formed on and project from opposite side surfaces of the housing 31, respectively, and the pins 34 are opposed respectively to the open distal ends of the guide grooves 25 in the connecting lever 23.

The lever fitting-type connector 1 has the above construction, and the male connector 2 and female connector 3 of this lever fitting-type connector 1 are connected together according to the following procedure.

First, the female connector 3 is brought into opposed relation to the male connector 2 as shown in FIG. 1. At this time, the fitting detection member 4 is kept retracted in the direction of arrow B as show in FIG. 3.

Figure 2:
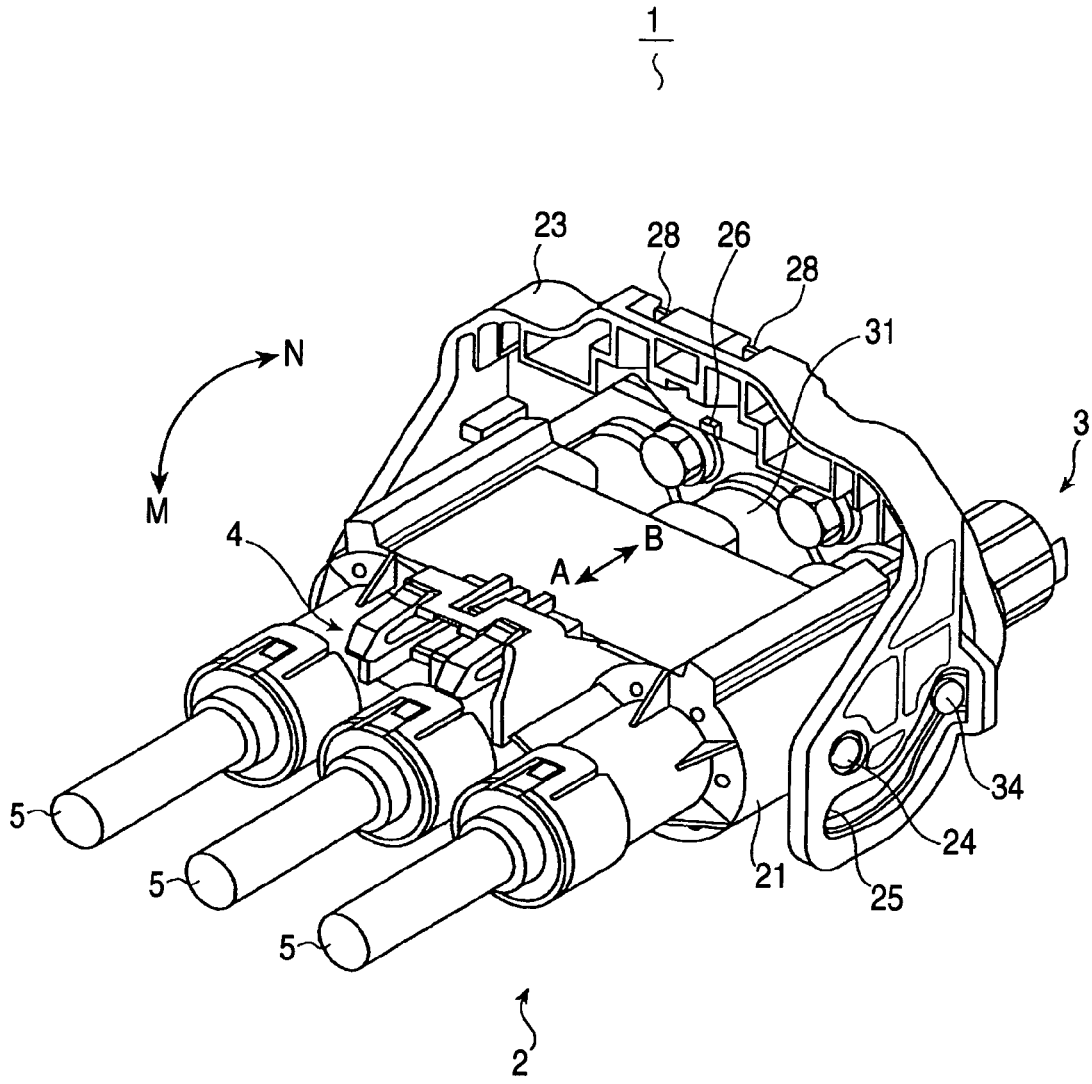
FIG. 2 is a perspective view of the lever fitting-type connector of FIG. 1 in a provisionally-fitted condition.

Then, the female connector 3 is inserted into the male connector 2 to be provisionally fitted therein as shown in FIG. 2. As a result, the male terminals 22 in the male connector 2 are electrically connected respectively to the female terminals 32 in the female connector 3. Also, the pins 34 on the female connector 3 are engaged respectively in the open distal ends of the guide grooves 25 in the connecting lever 23.

Figure 5:
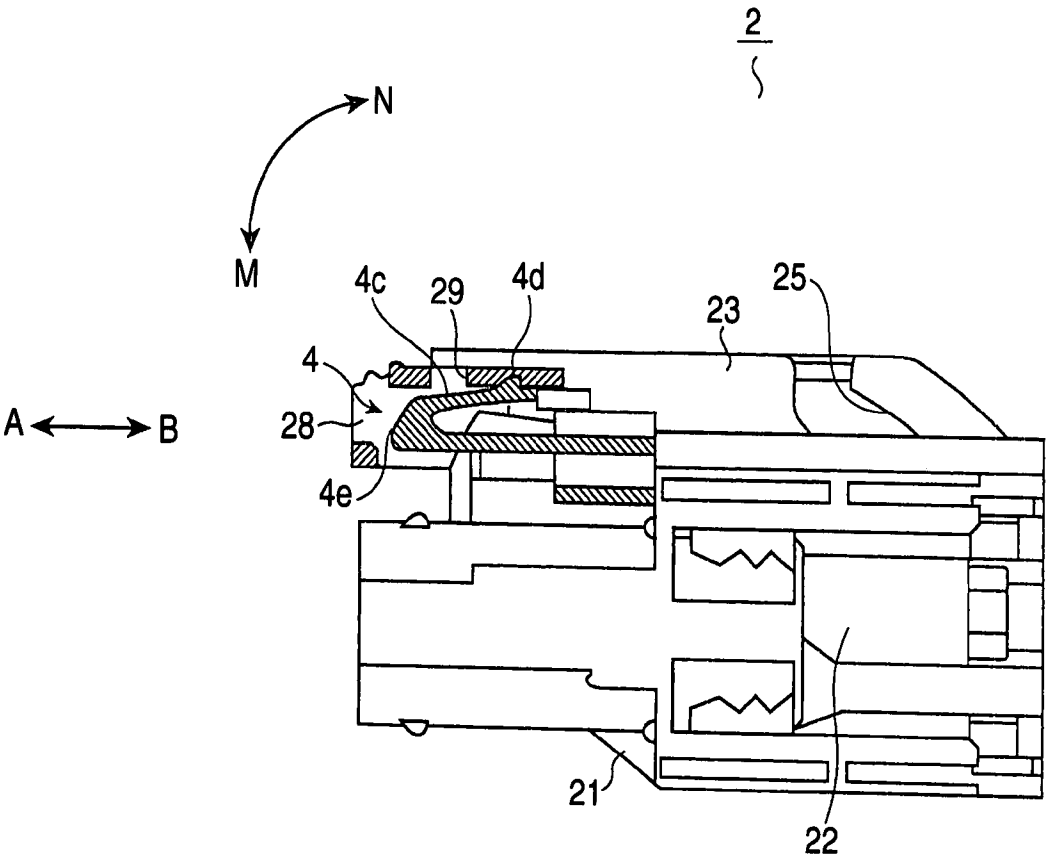
FIG. 5 is a cross-sectional view of the lever fitting-type connector of FIG. 1 in a completely-fitted (non-locked) condition.

Then, the connecting lever 23 is pivotally moved in the direction of arrow M through an angle of about 90 degrees as shown in FIGS. 3 and 5. As a result, each of the guide grooves 25 is angularly moved about the pin 24, with the pin 34 kept engaged in the guide groove 25. At this time, the distance between each pin 24 and the corresponding pin 34 (that is, the distance between the male connector 2 and the female connector 3) is gradually decreasing in accordance with the pivotal movement of the connecting lever 23 since the guide groove 25 is so formed that the distance between the guide groove 25 and the pin 24 is decreasing gradually from the open distal end of the guide groove 25 toward the inner end thereof. As a result, the female connector 3 is completely fitted relative to the male connector 2. Also, when the connecting lever 23 is thus pivotally moved in the direction of arrow M through the angle of about 90 degrees, the provisionally-retaining lock cancellation projection 26 depresses the provisionally-retaining portion 4*b* of the fitting detection member 4, and therefore the retaining engagement of the provisionally-retaining portion 4*b* with the housing 21 of the male connector 2 is canceled, so that the fitting detection member 4 is allowed to move forward in the direction of arrow A.

Figure 6:
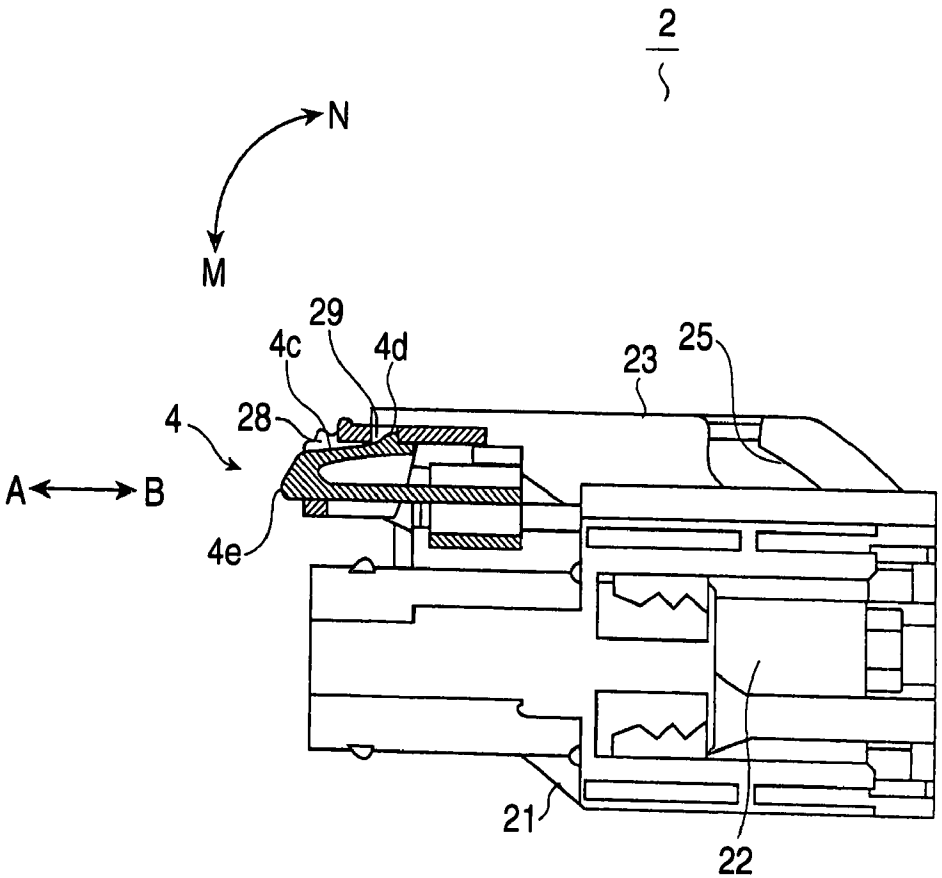
FIG. 6 is a cross-sectional view of the lever fitting-type connector of FIG. 1 in a completely-fitted (locked) condition.

Therefore, the fitting detection member 4 is moved forward in the direction of arrow A as shown in FIGS. 6 and 7. As a result, the fitting detection member 4 is located in a proper lock position, and the elastic arms 4*c* are engaged respectively in the fitting detection member engagement holes 28 in the connecting lever 23, and also the return prevention claws 4*d* are engaged respectively in the completely-retaining lock engagement holes 29 in the connecting lever 23. At this time, each return prevention claw 4*d* is smoothly brought into fitting engagement with the corresponding completely-retaining lock engagement hole 29 since the distal end portion of each elastic arm 4*c* of the fitting detection member 4 can be elastically deformed upward and downward.

As a result, the connecting lever 23 is locked to the housing 21 of the male connector 2 by the fitting detection member 4. Also, the fitting detection member 4 is locked against rearward movement in the direction of arrow B through the return prevention claws 4*d* engaged respectively in the completely-retaining lock engagement holes 29.

Thus, the operation for connecting the male connector 2 and the female connector 3 together is finished.

In the lever fitting-type connector 1 in which the male connector 2 and the female connector 3 are thus connected together, the return prevention claws 4*d* are engaged respectively in the completely-retaining lock engagement holes 29 in the connecting lever 23, and therefore even when the connector 1, mounted on an automobile, undergoes vibrations, the fitting detection member 4 will not be disengaged from the connecting lever. Therefore, the locked condition of the connecting lever 23 will not be canceled.

Further, whether or not the fitting detection member 4 is located in the proper lock position can be easily confirmed by touching and viewing the fitting detection member 4.

Namely, the operator tries to touch the lock confirmation portions 4*e* with the fingers, and if the lock confirmation portions 4*e* project respectively from the fitting detection member engagement holes 28 (formed in the connecting lever 23) in the direction of arrow A as shown in FIGS. 6 and 7, it is judged that the fitting detection member 4 is disposed in the proper lock position. At this time, the judgment is formed by confirming the projecting of the lock confirmation portions 4*e*, and thus this method is different from the related confirmation method in which the judgment is formed by confirming whether or not the fitting detection member 4 is disposed flush with the connecting lever 23, and therefore even an unskilled operator can properly form the correct judgment. Even in the case where it is difficult to view the fitting detection member as in a situation in which a space is severely limited, the correct judgment can be formed by touching the fitting detection member 4, and therefore there is no problem with the efficiency of the operation.

The operator views the lock confirmation portions 4*e*, and if the lock confirmation portions 4*e* project respectively from the fitting detection member engagement holes 28 (formed in the connecting lever 23) in the direction of arrow A, the operator can judge that the fitting detection member 4 is disposed in the proper lock position. The connecting lever 23 is red, while the lock confirmation portions 4*e* of the fitting detection member 4 is blue-green. Namely, the relationship of complementary colors is established between the connecting lever 23 and the lock confirmation portions 4*e*, and therefore good visual confirmation can be obtained, and if the lock confirmation portions 4*e* project respectively from the fitting detection member engagement holes 28 in the connecting lever 23, this can be easily visually confirmed at a glance. In this respect, also, it can be correctly judged whether or not the fitting detection member 4 is disposed in the proper lock position.

Furthermore, each of the elastic arms 4*c* of the fitting detection member 4 is formed into a U-shape, and is disposed generally in opposed relation to the provisionally-retaining portion 4*b*, and therefore the fitting detection member 4 can be formed into a compact size.

In the above embodiment, the connecting lever 23 is red, while the lock confirmation portions 4*e* of the fitting detection member 4 are blue-green, and thus the relationship of complementary colors is established between the two so that the visual confirmation can be enhanced. However, with respect to the two colors, a combination of other colors can be used in so far as these colors are different from each other.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japan Patent Application No. 2004-107358 filed on Mar. 31, 2004, the content of which is incorporated herein for reference.

What is claimed is:

1. A lever fitting-type connector, comprising:

a first connector, on which a fitting detection member is slidably mounted;

a second connector, which is adapted to be fitted into the first connector; and a connecting lever, which is provided on either one of the first and second connectors for operating the first and second connectors from a provisionally fitted condition to a completely fitted condition to each other, wherein the fitting detection member slides in a direction away from the second connector to a lock position so that the fitting detection member is engaged with a first engagement hole of the connecting lever to lock the connecting lever in the completely fitted condition; and wherein when the fitting detection member is positioned at the lock position, a lock confirmation portion of the fitting detection member is projected from both of the first engagement hole and a distal end face of the connecting lever.

2. The lever fitting-type connector as set forth in claim 1, wherein the fitting detection member includes:

a body portion; and an elastic arm formed on the body portion such that the elastic arm is turned back from the body portion;

wherein the elastic arm has a claw for engaging with a second engagement hole of the connecting lever to prevent a movement of the body portion; and wherein the lock confirmation portion is formed at a turned back portion of the elastic arm.

3. The lever fitting-type connector as set forth in claim 1, wherein the lock confirmation portion is different in color from the connecting lever.

4. The lever fitting-type connector as set forth in claim 1, wherein a color of the lock confirmation portion and a color of the connecting lever have a relationship of complementary colors.

5. The lever fitting-type connector as set forth in claim 1, wherein the lock confirmation portion is formed at a distal end of the fitting detection member in a sliding direction of the fitting detection member toward the first engagement hole.

6. The lever fitting-type connector as set forth in claim 1, wherein the fitting detection member is locked in the provisionally fitted condition; and wherein the lock state of the fitting detection member is released by a turn operation of the connecting lever to the completely fitted condition.

7. The lever fitting-type connector as set forth in claim 6, wherein the fitting detection member is enveloped by the connecting lever at time prior to the positioning of the fitting detection member at the lock position.

8. A lever fitting-type connector, comprising:

a first connector, on which a fitting detection member is slidably mounted;

a second connector, which is adapted to be fitted into the first connector; and a connecting lever, which is provided on either one of the first and second connectors for operating the first and second connectors from a provisionally fitted condition to a completely fitted condition to each other, wherein the fitting detection member slides to a lock position so that the fitting detection member is engaged with a first engagement hole of the connecting lever to lock the connecting lever in the completely fitted condition;

wherein when the fitting detection member is positioned at the lock position, a lock confirmation portion of the fitting detection member is projected from both of the first engagement hole and a distal end face of the connecting lever; and wherein the fitting detection member comprises:

a body portion; and an elastic arm formed on the body portion such that the elastic arm is turned back from the body portion;

wherein the elastic arm has a claw for engaging with a second engagement hole of the connecting lever to prevent a movement of the body portion; and wherein the lock confirmation portion is formed at a turned back portion of the elastic arm.

9. A lever fitting-type connector, comprising:

a first connector, on which a fitting detection member is slidably mounted;

a second connector, which is adapted to be fitted into the first connector; and a connecting lever, which is provided on either one of the first and second connectors for operating the first and second connectors from a provisionally fitted condition to a completely fitted condition to each other, wherein the fitting detection member slides to a lock position so that the fitting detection member is engaged with a first engagement hole of the connecting lever to lock the connecting lever in the completely fitted condition;

wherein when the fitting detection member is positioned at the lock position, a lock confirmation portion of the fitting detection member is projected from both of the first engagement hole and a distal end face of the connecting lever;

wherein the fitting detection member is locked in the provisionally fitted condition; and wherein the lock state of the fitting detection member is released by a turn operation of the connecting lever to the completely fitted condition.

* * * * *